US008960092B2

(12) United States Patent
Farizy et al.

(10) Patent No.: US 8,960,092 B2
(45) Date of Patent: Feb. 24, 2015

(54) DEVICE FOR SETTING OFF AN AVALANCHE

(75) Inventors: Bruno Farizy, St Jean de la Ponte (FR); Jean-Marc Neuville, Sassenage (FR); Philippe Berthet-Rambaud, Chateauneuf (FR); Pascal Roux, Le Sappey en Chartreux (FR)

(73) Assignee: Technologie Alpine de Securite-TAS, Sainte-Helene-du-Lac (FR)

( * ) Notice: Subject to any disclaimer, the term of this patent is extended or adjusted under 35 U.S.C. 154(b) by 0 days.

(21) Appl. No.: 13/640,224

(22) PCT Filed: Apr. 7, 2011

(86) PCT No.: PCT/FR2011/050786

§ 371 (c)(1),
(2), (4) Date: Feb. 6, 2013

(87) PCT Pub. No.: WO2011/124854

PCT Pub. Date: Oct. 13, 2011

(65) Prior Publication Data

US 2013/0133543 A1 May 30, 2013

(30) Foreign Application Priority Data

Apr. 9, 2010 (FR) ..... 10 52682

(51) Int. Cl.
*F42D 3/00* (2006.01)

(52) U.S. Cl.
CPC ..... *F42D 3/00* (2013.01)
USPC ..... 102/302; 102/363

(58) Field of Classification Search
USPC ..... 102/301, 302, 363, 402, 403; 89/1.11, 89/1.1
See application file for complete search history.

(56) References Cited

U.S. PATENT DOCUMENTS 5,107,765 A * 4/1992 Schippers ..... 102/302
6,374,717 B1 * 4/2002 Schippers ..... 89/7

(Continued)

FOREIGN PATENT DOCUMENTS

FR 2 636 729 3/1990
WO WO 2007/096524 A1 8/2007
WO WO 2009/080977 A2 7/2009

OTHER PUBLICATIONS

Jun. 17, 2011 Written Opinion of the International Searching Authority issued in International Application No. PCT/FR2011/050786.

(Continued)

*Primary Examiner* — James S Bergin
(74) *Attorney, Agent, or Firm* — Oliff PLC

(57) ABSTRACT

Device for setting off an avalanche, comprising a support intended to be fixed to the mounting side, for example on a concrete slab, and an enclosure one end of which is open, this enclosure being mounted on the support, said open end of the enclosure being intended to face towards the snow cap. The device further comprises means of filling the enclosure with an explosive gaseous mixture, firing means designed to set off the explosion of the said mixture and a remote-communication system. The enclosure is mounted removably on the support, by fitting its lower face, intended to receive the gaseous mixture, onto a bearing piece of the support, and the enclosure is autonomous in terms of energy supply and carries means of storing the gases that are intended to form the gaseous mixture.

13 Claims, 2 Drawing Sheets

(56) References Cited

U.S. PATENT DOCUMENTS

| | | | | |
|---|---|---|---|---|
| 7,707,938 | B2 * | 5/2010 | Hisel | 102/302 |
| 8,342,096 | B2 * | 1/2013 | Greipl | 102/363 |
| 8,430,032 | B2 * | 4/2013 | Farizy et al. | 102/363 |
| 2006/0254449 | A1 | 11/2006 | Hisel | |
| 2011/0005423 | A1 | 1/2011 | Greipl | |
| 2012/0318159 | A1 * | 12/2012 | Constant et al. | 102/302 |

OTHER PUBLICATIONS

Jun. 17, 2011 International Search Report issued in International Application No. PCT/FR2011/050786 (with translation).

* cited by examiner

DEVICE FOR SETTING OFF AN AVALANCHE

The present invention relates to a device for setting off avalanches and notably snow avalanches.

Such a device is used for preventively setting off avalanches in locations where accumulation of snow may lead to significant risks of avalanches endangering goods or persons, notably in connection with the existence of transport infrastructures, ski regions, inhabited or mining areas.

Devices and techniques for setting off voluntarily avalanches are already known.

A first technique consists of having an operator place explosive charges at the specific location where the intention is to set off an avalanche. This placement may be accomplished either from a helicopter by dropping, or by launching from the ground, the charge which may then be deposited, slid or thrown at the suitable location. The firing of the charge, in both cases, is generally obtained with a slow wick or electrically.

The risks inherent to this technique are significant. In addition to the risks directly related to the handling of explosives, the operator for placing explosive charges, directly intervening on the ground, has to go into often steep areas, the snow cap of which is unstable. These interventions sometimes have to be further accomplished whether this be for placing charges on the ground or transported by helicopter, under tricky weather conditions.

In order to reduce these risks related to the displacement over the firing area, remote setting-off techniques have been set into place.

Remote setting-off techniques use military weapons such as rocket launchers or shell launchers in order to cause the explosion on the site. This type of device is not suitable for some legislations, such as French legislation, which prohibit the storage of primed charges.

The device known under the trade name CATEX uses an explosive-transporting cable system passing above one or several avalanche corridors. This type of solution, if it allows limitation of the risks related to displacement on the locations of the setting-off of the avalanche, does not provide any solution as regards the handling and storage of explosives. This device further requires the costly installation of a system of pylons supporting the transport cable, this over distances which may be very long.

A way in order to reduce the risks related to the handling of explosives is the use of explosive gases for generating a shock wave used for setting off the avalanche.

According to this principle, transportable devices are known which may be brought on site by helicopter transport. These devices, described in WO 2007/096524 and WO 2009/080977, both use a mixture of explosive gases in order to trigger an explosion above a snow cap. More specifically mention may be made of the device described in document WO 2009/080977. This device appears as a confinement enclosure open downwards and intended to be hung from a helicopter with a towing chain. This enclosure is therefore brought by the helicopter above the snow cap, in the area where an avalanche has to be set off. In order to set off an avalanche, this enclosure is filled with an explosive gas mixture which is lighter than air. This mixture is then fired most often electrically in order to generate an explosion. The shock wave which results from this, will then shake the snow cap and set off an avalanche. The main advantage of these devices is the possibility of being used on areas which are not equipped beforehand and this without any handling of explosive. The drawbacks remain those inherent to the use of the helicopter, i.e. operating costs which remain significant and the impossibility of intervening in bad weather.

Another type of device is the one known under the name of GAZEX. This type of device, described in document FR 2 636 729, comprises an exploder tube with a closed bottom mounted on a concrete support and the aperture of which is directed towards the snow cap. A gas circuit is used for filling the exploder tube with oxidizing gas and fuel gas, the ignition of which is provided by an ignition device, advantageously mounted on the rear of the exploder tube. The shockwave of the explosion which results from this is then directed, through the aperture of the tube, towards the snow cap thereby setting off the avalanche. This type of device comprises a sufficient reserve of gas for one season, installed in an adjacent technical room and a remotely controlled firing system with which among other advantages, complete autonomy and perfect safety for the operator may be obtained. The permanent installation of this device further gives the possibility of guaranteeing sufficient reproducible and sustainable power for protecting avalanche corridors of large sizes. The main drawbacks related to this type of device are the necessity of producing a heavy installation requiring a significant civil engineering operation for the device per se, the adjacent technical room and the connecting ducts connecting them and the requirement of carrying out its maintenance on the installation site which by definition is difficult to access.

Document US2006/0254449 describes a device for setting off avalanches comprising a foot anchored to the ground, on which a tubular pylon is engaged, bearing gas reservoirs feeding a gas mixing receptacle, in which the firing of the gas mixture is achieved.

The present invention aims at finding a remedy to these drawbacks.

The technical problem at the basis of the invention therefore consists of providing a device for setting off an avalanche which, having the properties of a permanent installation such as GAZEX, requires a less costly installation and with which maintenance may be facilitated.

For this purpose, the invention relates to a device for setting off an avalanche including a support intended to be attached to a mountainside, for example on a concrete slab, and an enclosure, one end of which is open, this enclosure being mounted on the support, said open end of the chamber being intended, under conditions of use, to face the snow cap, the device further including means for filling the enclosure with an explosive gaseous mixture, firing means designed for triggering off the explosion of the mixture and a remote communications system, characterized in that:

- the enclosure is removably mounted on the support, by fitting its lower face, intended to receive the gaseous mixture, onto a bearing part of the support which is openworked and faces upwards,
- and the enclosure is autonomous in terms of energy supply, and bears for this purpose, means for storing the gases which are intended to form the gas mixture and the firing means for the gaseous mixture.

The use of a device for setting off an avalanche which is autonomous in terms of energy supply, the removable enclosure of which bears the gas storing means and the firing means, gives the possibility, by disassembling the enclosure from its support, of transferring all the maintenance and recharging operations to a more accessible site than the one where a device is installed. Further, in the summer period, the enclosure may be disassembled from its support which limits the visual disturbances on the operating site. By arranging the gas storage means on the enclosure and not in a remote technical room it is also possible to reduce the costs for installing such a device.

It should be noted that the device is very simple, since the inner face of the enclosure forms both the enclosure for receiving the explosive gas mixture and the means for mounting the enclosure on the support.

Taking into account the respective structures of the enclosure and of the support, assembling and disassembling are carried out simply and rapidly, insofar that the assembling is performed by simply fitting the inner face of the enclosure onto the bearing part of the support. The assembling and disassembling operations are therefore limited to simple translations along an axis slightly inclined with respect to the vertical, and may for example be performed by displacing the enclosure on the end of a towing chain attached to a helicopter.

Advantageously, the inner face of the enclosure has a generally tapered shape, the support includes an anchor foot in the ground, whereof the upper end is equipped with a part for bearing the enclosure, including a crown-shaped base from which a tapered portion extends upwards with the same taper as the inner wall of the enclosure.

By using, for mounting the enclosure on the support, a bearing part having a crown-shaped base on which a tapered portion extends with the same taper as the enclosure, it is possible to have a stable installation of the enclosure by ensuring a perfect hold of the enclosure on the support.

Advantageously, the upper portion of the bearing part comprises several posts converging upwards, whereof the lower ends are fastened on the crown-shaped base.

The use of posts for the tapered portion of the bearing part, gives the possibility of obtaining a support of the enclosure over all or part of the height of the enclosure while providing a lightweight structure.

Preferentially, the bearing part includes means for guiding the enclosure such as skates or rollers.

By using guiding means such as skates or rollers, it is possible during the installation of the enclosure on the support, to guide the latter while avoiding the intervention of an operator in proximity to the support during this operation.

Advantageously, on the outer face of the enclosure are fastened functional pieces of equipment of the device, these pieces of equipment notably comprise means for storing gas such as at least one hydrogen bottle and at least one oxygen bottle, means for filling the enclosure with gas, such as expanders and solenoid valves, control means such as a microcontroller, equipment for storing electric energy, such as batteries and firing means, a protective shell being provided all around the equipment.

The layout of the functional pieces of equipment of the device, such as for example gas bottles, the filling means and the pieces of equipment for storing electric energy, on the removable enclosure of the device gives the possibility of being able to carry out maintenance on a site which is more accessible than the one where the device is installed.

Preferentially, the functional pieces of equipment are fastened on the outer face of the enclosure by means of damping supports.

This arrangement of the functional pieces of equipment on damping supports positioned on the outside of the enclosure gives the possibility of limiting the consequences of explosions on the gas circuit and the electric circuit.

Advantageously, the device comprises a security system such as an electric contact, monitoring the firing means and the filling means in order to make the latter inoperative when the enclosure is not installed on the support.

Such a security system allows safe transport of the enclosure between the maintenance site and the installation site of the device since it blocks all possibility of setting off the explosion when the enclosure is not properly installed on its support.

Preferentially, the device comprises a vibratory measuring system such as an accelerometer or a seismometer.

Such a vibration measurement system provides a means for checking the setting-off of the explosion upon using the device.

Advantageously, the enclosure is equipped with means for fastening a towing chain of a transport vehicle such as a helicopter, the means for fastening the towing chain including a ring with a flattened shape fastened to the upper end of the enclosure on the one hand and a catching device which, intended to be fastened to the end of the towing chain, includes an open hook located at the center of a conical enclosure, the upper end of which has an opening of oblong shape mating the shape of the ring.

Such means for fastening a towing chain give the possibility of carrying out fastening of the enclosure on the towing chain with which a transport vehicle is equipped, such as a helicopter, without any direct intervention of an operator on the site. Such a possibility allows this operation to be made safe, which may be dangerous for an operator on the ground because of the weight of the enclosure.

Preferentially, the bearing part is pivotally mounted on the foot of the support.

Advantageously, the support comprises means for adjusting the incline of the bearing part relatively to the foot so as to adjust the arrangement of the opening of the enclosure in relation to the snow cap.

By such a pivot mounting of the bearing part, it is possible to obtain the adequate incline of the enclosure and therefore of its aperture with respect to the snow cap in order to guide at best the shockwave of the explosion with view to setting off an avalanche with the device.

Advantageously, the support comprises on its periphery, reference members intended to guide a helicopter during the installation or the disassembly of the enclosure on the support.

Such members give the possibility to the helicopter pilot either coming for placing the enclosure or picking up the enclosure in order to carry out a maintenance operation, of localizing the support and thereby placing the enclosure on the support or the fastening means present on the enclosure, rapidly, without any long localization operation.

Advantageously, the device is made autonomous in terms of energy supply by energy producing means, such as solar panels or a wind turbine.

The use of energy producing means such as solar panels or a wind turbine, allows limitation of the maintenance interventions on the device since the additional energy supply of these means allows an increase in the duration between each operation for recharging the electrical storage means.

In any way, the invention will be well understood by means of the description which follows, with reference to the appended schematic drawing illustrating as a non-limiting example, an embodiment of this device for setting off an avalanche.

Figure 1:
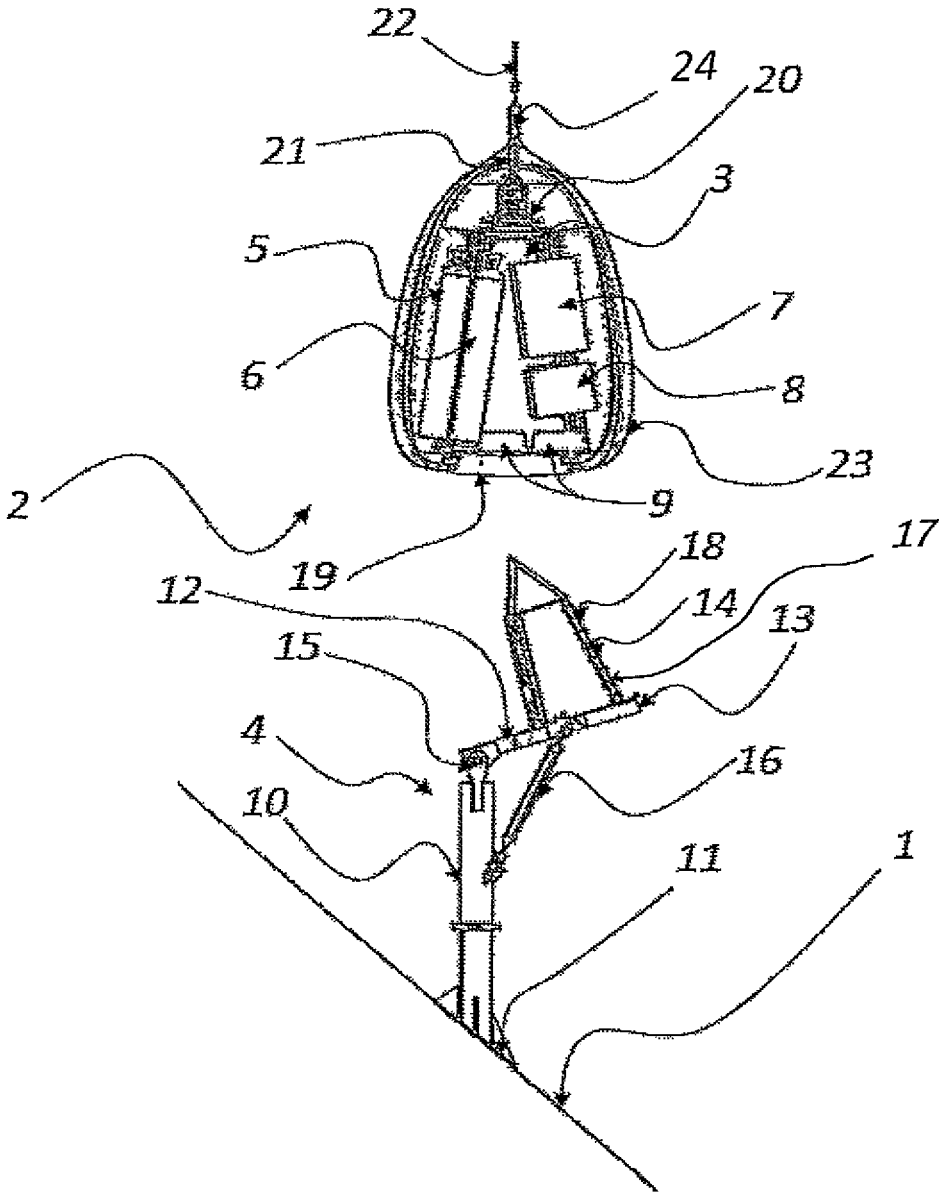
FIG. 1 is a side perspective view of a mountainside equipped with the device during the placement of the enclosure on its support.

FIG. 1 is a side view of a mountainside 1 equipped with a device 2 for setting off an avalanche according to the invention, during the installation of the enclosure 3 on a support 4. Such a device 2 comprises an enclosure 3 mounted on a support 4 intended to be fastened on the mountainside 1. The device 2 further includes means for storing gases 5, 6, means for filling the enclosure with an explosive gas mixture 7, firing means arranged so as to set off the explosion of said mixture, a remote communications system positioned in an enclosure 8 and electric energy storage means 9.

The support comprises a substantially vertical foot 10 fastened on the mountainside 1 by means of a base 11. This base 11 may be attached on a concrete slab. The upper end of this foot 10 is equipped with a bearing part 12 of the enclosure including a crown-shaped base 13 from which a tapered portion 14 extends upwards with the same taper as the inner wall of the enclosure 3. The bearing part 12 is pivotally mounted on the foot 10 by means of an axis 15. The connection of the bearing part 12 on the foot 10 also includes means 16 for adjusting the incline such as for example screw actuators 16. These actuators 16 have one of their ends connected to the foot 10 and the second one to the periphery of the base 13 of the bearing part 12. They form additional supports for the bearing part 12 on the foot 10. The incline of the bearing part 12 may therefore be adjusted by modifying the length of the screw actuators 16.

The tapered portion 14 of the bearing part 12 comprises three posts 17 converging upwards, the lower ends of which are fastened on the crown-shaped base 13. These three posts 17 are equipped with a plurality of castors 18, the axis of rotation of which are perpendicular to the posts 17 of the bearing part 12 and tangent to the conical envelope of the tapered portion 13. Thus, during the installation of the enclosure 3 on the support 4, the inner walls of the enclosure 3 may slide along these castors 18 with reduced friction.

The support, depending on the needs, may be equipped with reference members intended to guide a helicopter during the installation or disassembly of the enclosure 3 on the support 4. These members allow the helicopter pilot, upon approaching the support 4, to localize the support 4. The support 4 may also be equipped with stepping boards, thereby allowing if need be, an operator to come and unhook/hook up the enclosure 3 during its installation/disassembly with respect to the support 4.

Figure 2:
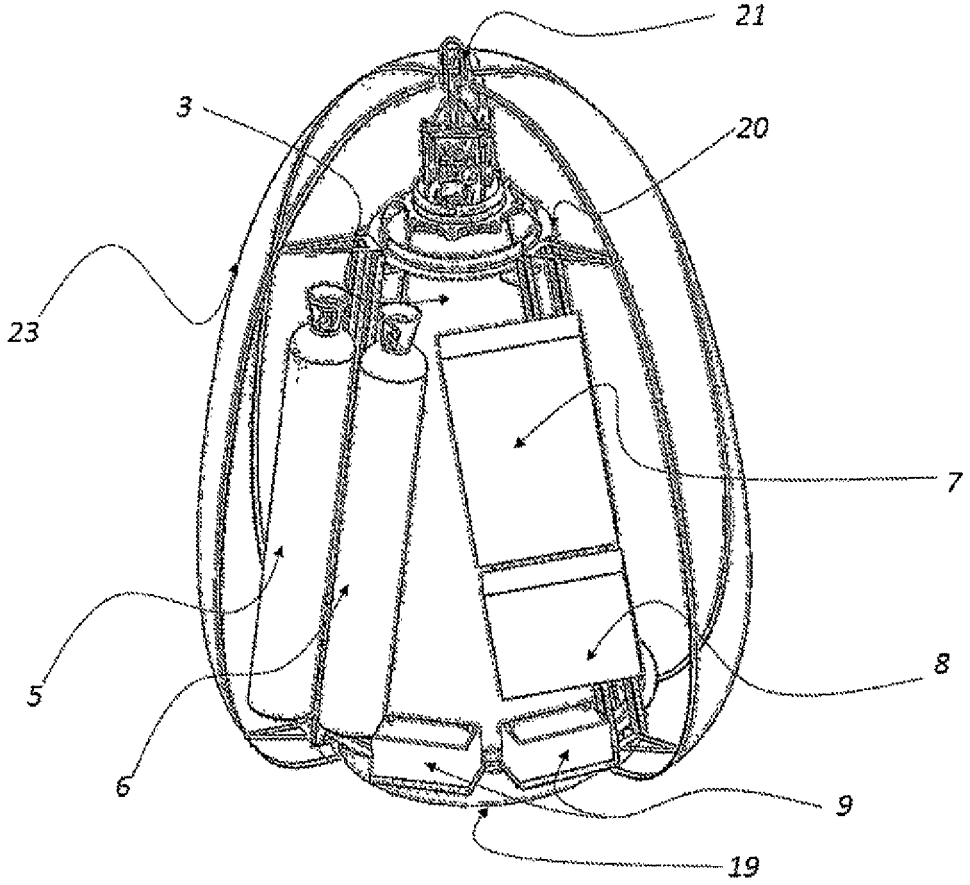
FIG. 2 is a perspective view of the enclosure of the device, the outer shell having been partly removed.

As illustrated in FIG. 2, the enclosure 3 is a metal enclosure 3 with a general tapered shape, the base 19 of which is open. This open base 19 is intended, when the enclosure 3 is installed on the support 4, to be turned towards the snow cap. This enclosure 3 supports on its outer face the functional pieces of equipment 5, 6, 7, 9 of the device such as the gas storage 5, 6 and the control means positioned in the same enclosure 8 as the remote communications system. It also includes on its upper portion 20 fastening means 21 intended for a towing chain 22 from a transport vehicle such as a helicopter. The enclosure further comprises a protective shell 23 positioned around the enclosure and the functional pieces of equipment of the device.

The functional pieces of equipment 5, 6, 7, 9 of the device comprise gas storage means 5, 6 for a fuel gas and an oxidizing gas, such as a hydrogen bottle 5 and an oxygen bottle 6, the gas distribution means 7 which, being connected to the gas storage means 5, 6, may be expanders and solenoid valves, means for igniting the gas mixture obtained by the distribution means 7, such as for example, a piezoelectric system of a spark plug, a device allowing a spark to be generated or a heating resistor, control means, such as a microcontroller, which controls the distribution means 7 and the firing means, a long distance remote communications system generally using the mobile telephone system or the radio, measurement systems, safety equipment, and a set of batteries 9. This assembly of pieces of equipment 5, 6, 7, 9 is positioned on damping supports on the outside of the enclosure in order to limit the consequences of the explosions on the gas circuit and the electric circuit.

The protective shell 23 is installed around the assembly of the functional pieces of equipment 5, 6, 7, 9 positioned on the perimeter of the enclosure 3 in order to protect them from bad weather and risks of impacts inherent to the transport operations by helicopter. To do this, the shell 23 with a general ovoidal shape, surrounds the enclosure 3, an opening on its bottom being made for fastening the shell 23 on the perimeter of the open base 19 of the enclosure 3. An opening on its upper portion is also made in order to allow the passage of fastening means 21. The low portion of the shell 23 is made in a material which may withstand multiple impacts related to the transport by helicopter, such as for example steel, and the upper portion is made in a more lightweight material such as a composite material.

Figure 3:
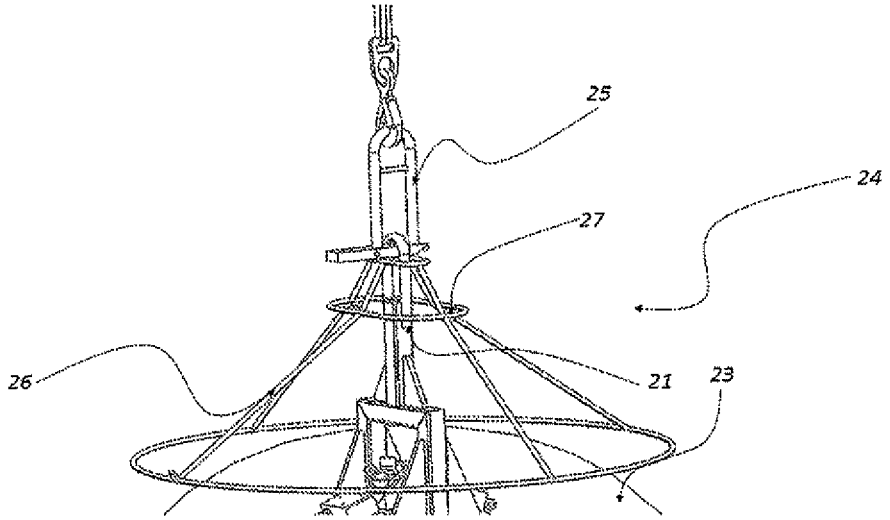
FIG. 3 is a perspective view with an enlarged scale of the system for hooking up the enclosure to a transport towing chain.

The fastening means 21, intended for a towing chain 22, present on the device 2, comprise, as illustrated in FIG. 3, an elongated ring 21 with a flattened shape fastened to the upper end 20 of the enclosure 3 on the one hand and a catching device 24 which is intended to be fastened to the end of the towing chain 22 on the other hand. This catching device includes an open hook 25 located at the center of a conical enclosure 26, the upper end of which 27 has an opening with an oblong shape mating the shape of the ring 21.

The device 2 also comprises security and control equipment in order to secure and control the operation of the device 2. Thus, the enclosure 3 is equipped with security systems, such as an electric contact positioned on the opening of the enclosure 19 in contact with the bearing part 12, controlling the firing means and the filling means so as to make the latter inoperative when the enclosure 3 is not installed on the support 4. The device further comprises, in order to control the effectiveness of setting off an avalanche, a vibratory measuring system such as an accelerometer or a seismometer allowing measurement of the vibrations of the enclosure related to the setting-off of the explosion. The device may also include a means for measuring outdoor conditions such as a weather station.

The device 2 also comprises electric energy storage means 9 positioned on the enclosure 3, such as batteries 9 which make it autonomous in terms of energy supply. These means may be coupled with energy producing means, such as solar panels or a wind turbine. These means may be positioned on the shell of the enclosure 23.

The operations for installing an enclosure 3 on the support 2 are carried out as follows. The enclosure 3, the electric storage 9 and gas storage 5, 6 means of which are pre-charged, is installed at the end of a towing chain 22 from a helicopter, by means of a hook, the opening and closing of which are preferentially electrically controlled from the helicopter, and fastening means 21 positioned on the enclosure 3. It is brought above the support 4. During this approach, the pilot uses the reference members positioned around the support 4 in order to place the enclosure 3 exactly above the support 4, the opening 19 of the enclosure 3 being aligned with the tapered portion 14 of the bearing part 12. The enclosure 3 is then lowered along the mating portion 14 present on the bearing part 12 with friction reduced to a minimum by the presence of the castors 18 on this part 12. During this lowering, the enclosure 3 will bear upon the base 13 of the supporting part 12. The enclosure 3, thereby set into place, is either detached by opening the electrically controlled hook or by the intervention of an operator who, using the stepping boards present on the support 4, will open the hook. The enclosure 3 set into place and the security system being disengaged by the enclosure 3 bearing upon the bearing part 12 of the support 4, are ready for use.

During the setting-off by the device 2 of a preventive avalanche, an operator, in safety, on a location away from the installation site, sends the command for triggering the device 2 by using the remote communication system. These commands are processed by the microcontroller which, depending on these commands, opens for a predetermined time the gas solenoid valves for the fuel gas and oxidizing gas. These gases, generally hydrogen and oxygen, selected so as to be more lightweight than air, fill the enclosure 3. The intended mixture having been attained, the microcontroller controls the firing means in order to set off the explosion. The shockwave of the explosion is focused towards the snow cap. The energy is thus transmitted to the already unstable snow cap, gives the possibility of detaching the snow and setting off a preventive avalanche. During this explosion, the shockwave of the explosion transmits a portion of its energy to the enclosure 3 by exerting on the latter an upward thrust. The enclosure 3 is then displaced upwards while remaining in contact with the posts 17 of the bearing part 12. The maximum height having been reached, the enclosure 3 guided by the guiding means 18 which are the castors 18 positioned on the posts 17 of the bearing part 12, moves down again and is replaced in contact with the base 13 of the bearing part 12. This movement of the enclosure 3 is recorded by the vibratory measuring system and then transmitted, through the long distance remote communications system to the operator.

During a maintenance or recharging operation for the storage means of the device 5, 6, 9, the procedure is the following. The helicopter is brought over the site equipped with its towing chain 22 and with the portion of the fastening system of the towing chain on the device 2. It is positioned above the enclosure 3, with the base of the conical enclosure 26 of the catching device 24 facing the ring 21 with which the upper portion 20 of the enclosure 3 is equipped. The towing chain 22 is lowered so that the conical enclosure 26 surrounds the ring 21, the edges of the conical enclosure 26 guiding the ring 21 to the center of the enclosure 26. The oblong opening 27 present on the top of the enclosure 26 will, by its flattened shape of the ring 21, cause rotation of the enclosure 26 so that the ring 21 penetrates into this opening 27. With this rotation of the enclosure 26, it is possible to suitably position the open hook 25 relatively to the ring 21 with which the enclosure 3 is equipped. In this position, as illustrated by FIG. 3, the hook 25 opens for receiving the ring 21 and closes again while thereby holding the ring 21. The helicopter may then fly away while lifting the enclosure 3 in order to extract it from the support 4. It is then transported onto the maintenance site in order to carry out the required maintenance and recharging operations.

As this is obvious, the invention is not limited to the single embodiment of this avalanche setting-off device, described above as an example, on the contrary it encompasses all the alternative embodiments such as for example the use of an enclosure with a shape other than a tapered shape or the use of a fuel gas other than hydrogen.

The invention claimed is:

1. A device for setting off an avalanche, comprising:

a support configured for fixing to a mountainside, and an enclosure including an open end, the enclosure being mounted on the support, said open end of the enclosure being configured to face towards the snow cap, a means of for filling the enclosure with an explosive gaseous mixture, a firing means configured to set off the explosion of said mixture, and a remote communication system, wherein the enclosure includes an inner face configured to receive the gaseous mixture and is mounted removably on the support, by fitting the inner face of the enclosure onto a bearing piece of the support, the bearing piece having an opening and facing upward, wherein the enclosure comprises an energy supply and is energetically self-sufficient and carries the firing means and means for storing the gases that are intended to form the gaseous mixture.

2. The device according to claim 1, wherein the inner face of the enclosure has a generally tapered shape, and the support comprises an anchor foot anchored in the ground an upper end of the anchor foot being equipped with the bearing piece, the bearing piece comprising a crown-shaped base from which a tapered portion extends upward with the same taper as the inner face of the enclosure.

3. The device according to claim 2, wherein the upper part of the bearing piece has several posts converging upward whereof the lower ends are fastened on the crown-shaped base.

4. The device according to claim 2, wherein the bearing piece includes guide means for guiding the enclosure.

5. The device according to claim 2, wherein the bearing piece is pivotably mounted on the anchor foot of the support.

6. The device according to claim 5, wherein the support includes means for adjusting the incline of the bearing piece in relation to the anchor foot so as to adjust the arrangement of the opening of the enclosure in relation to the snow cap.

7. The device according to claim 1, wherein fastened on the outer surface of the enclosure are functional equipment of the device, said equipment including the gas storage means, means for filling the enclosure with gas, control means, electrical energy storage equipment, and a protective shell being provided around the equipment.

8. The device according to claim 7, wherein the functional equipment is fastened on the outer surface of the enclosure using damping supports.

9. The device according to claim 1, further comprising a security system, monitoring the firing means and the filling means so as to make the firing means and the filling means inoperative when the enclosure is not installed on the support.

10. The device according to claim 1, further including a vibratory measuring system.

11. The device according to claim 1, wherein the enclosure is equipped with means for fastening a towing chain of a transport vehicle, the means for fastening the towing chain comprising:

a ring with a flattened shape fastened to the upper end of the enclosure, and a hooking device which is configured to be fastened to the end of the towing chain, and comprises an openable hook situated at the center of a conical enclosure the upper end of which has an oblong opening complementary to the shape of the ring.

12. The device according to claim 1, wherein the support has, on its periphery, reference members intended to guide a helicopter during installation or disassembly of the enclosure on the support.

13. The device according to claim 1, wherein it is made autonomous in terms of energy supply by energy-producing means.

* * * * *